US008872717B2

(12) United States Patent
Gunnels

(10) Patent No.: US 8,872,717 B2
(45) Date of Patent: Oct. 28, 2014

(54) HIGH ISOLATION DUAL POLARIZED DIPOLE ANTENNA ELEMENTS AND FEED SYSTEM

(75) Inventor: Robert Gunnels, Homer Glen, IL (US)

(73) Assignee: PC-Tel, Inc., Bloomingdale, IL (US)

( * ) Notice: Subject to any disclaimer, the term of this patent is extended or adjusted under 35 U.S.C. 154(b) by 120 days.

(21) Appl. No.: 13/428,293

(22) Filed: Mar. 23, 2012

(65) Prior Publication Data

US 2012/0242554 A1 Sep. 27, 2012

Related U.S. Application Data

(60) Provisional application No. 61/467,435, filed on Mar. 25, 2011.

(51) Int. Cl.
*H01Q 9/10* (2006.01)
*H01Q 9/28* (2006.01)

(52) U.S. Cl.
CPC . *H01Q 9/285* (2013.01); *H01Q 9/10* (2013.01)
USPC ..... 343/816; 343/820

(58) Field of Classification Search
CPC ..... H01Q 9/10; H01Q 1/50; H01Q 21/00
USPC ..... 343/816, 820, 821, 822, 797, 795
See application file for complete search history.

(56) References Cited

U.S. PATENT DOCUMENTS

| | | | | |
|---|---|---|---|---|
| 4,825,220 | A | 4/1989 | Edward et al. | |
| 5,952,983 | A | 9/1999 | Dearnley et al. | |
| 6,034,649 | A | 3/2000 | Wilson et al. | |
| 6,069,590 | A | 5/2000 | Thompson, Jr. et al. | |
| 6,313,809 | B1 * | 11/2001 | Gabriel et al. | 343/797 |
| 7,324,057 | B2 * | 1/2008 | Argaman et al. | 343/779 |
| 7,616,168 | B2 | 11/2009 | Tillery | |
| 2005/0057417 | A1 * | 3/2005 | Teillet et al. | 343/797 |
| 2005/0110699 | A1 * | 5/2005 | Timofeev et al. | 343/797 |

FOREIGN PATENT DOCUMENTS

WO WO 2006/079993 A1 8/2006

OTHER PUBLICATIONS

Extended European Search Report, dated Jun. 25, 2012, corresponding to Application No. EP 12 16 1275.

* cited by examiner

*Primary Examiner* — Hoanganh Le
(74) *Attorney, Agent, or Firm* — Husch Blackwell LLP

(57) ABSTRACT

An apparatus that achieves high isolation between dipoles and feed systems is provided. The apparatus includes a plurality of transmission lines, a first dipole electrically connected to a first set of the plurality of transmission lines, and second dipole electrically connected to a second set of the plurality of transmission lines. The electric field of the first dipole is parallel to an electric field of the first set of the plurality of transmission lines, and an electric field of the second dipole is parallel to an electric field of the second set of the plurality of transmission lines.

24 Claims, 5 Drawing Sheets

HIGH ISOLATION DUAL POLARIZED DIPOLE ANTENNA ELEMENTS AND FEED SYSTEM

CROSS-REFERENCE TO RELATED APPLICATIONS

This application claims priority to U.S. Provisional Patent Application No. 61/467,435 filed Mar. 25, 2011 and titled "High Isolation Dual Polarized Dipole Antenna Elements and Feed System". U.S. Application No. 61/467,435 is hereby incorporated by reference.

FIELD

The present invention relates generally to antennas. More particularly, the present invention relates to high isolation dual polarized dipole antenna elements and feed systems.

BACKGROUND

Orthogonal dipoles are used in many known antennas to provide dual polarization. For example, FIG. 1 is a schematic view of an apparatus 100 with orthogonal dipoles and associated feed systems as known in the art. As seen in FIG. 1, the apparatus 100 can include first and second interlacing members 112, 122. Notches or other cut-outs can be included in each member 112, 122 to facilitate the members 112, 122 sliding together to interlace.

Each member 112, 122 can include a center support structure and a dipole 110 (Dipole A), 120 (Dipole B), respectively. However, it is to be understood that each member 112, 122, including its respective center support structure and dipole 110, 120, can be one integral member. In some embodiments, the members 112, 122 can be mounted to a main printed circuit board (PCB) 130 that functions as a ground plane.

A seen in FIG. 1, a first feed microstrip 116 can be disposed on at least a portion of the center support structure of the first member 112, and a second feed microstrip 126 can be disposed on the center support structure of the second member 122. In some embodiments, the feed microstrips 116, 126 can include tuning elements, such as inductors, capacitors, and transformers.

The first feed microstrip 116 can be associated with the first dipole 110, and the second feed microstrip 126 can be associated with the second dipole 120. As seen in FIG. 1, the first feed microstrip 116 and the first dipole 110 can be in the same plane, for example, a plane parallel to the X-Z plane. Similarly, the second feed microstrip 126 and the second dipole 120 can be in the same plane, for example, a plane parallel to the Y-Z plane.

In the apparatus 100 shown in FIG. 1, if the dipoles 110, 120 have coincident centers and are perfectly orthogonal to one another, no coupling will occur between the dipoles 110, 120 themselves. However, the apparatus 100 will still provide poor isolation characteristics because coupling can occur between each dipole and the orthogonal dipole's feed microstrip. For example, this coupling can occur because the electric field of one dipole is parallel with the electric field of the orthogonal dipole's feed microstrip.

As seen in FIG. 1, the first feed microstrip 116 associated with the first dipole 110 is oriented such that its electric field $E_{A\ MICROSTRIP}$ is parallel to the electric field for the second dipole 120, $E_B$. Accordingly, coupling occurs between the second dipole 120 and the feed microstrip 116 for the first dipole 110.

The feed microstrip 126 associated with the second dipole 120 is oriented such that its electric field $E_{B\ MICROSTRIP}$ is parallel to the electric field for the first dipole 110, $E_A$. Accordingly, coupling occurs between the first dipole 110 and the feed microstrip 126 for the second dipole 120.

FIG. 2 is a graphical representation of the isolation achieved by prior art systems, for example, the apparatus 100 shown in FIG. 1. As seen in FIG. 2, the isolation can be relatively poor. However, because inter-port isolation is an important factor in antenna performance, these types of poor isolation characteristics are undesirable.

To improve isolation in known antennas, parasitic structures have been placed near radiating elements. The addition of parasitic structures has somewhat improved isolation because the mutual coupling provided by the parasitic elements can help to cancel a portion of the existing coupling between the two polarizations. However, the use of parasitic elements to improve isolation can have adverse effects on the radiation pattern performance of the antenna. Furthermore, parasitic elements typically provide only modest improvements in isolation, but increase cost.

In view of the above, there is a need for a dual polarized antenna and associated feed system with improved isolation.

DETAILED DESCRIPTION

Figure 1:
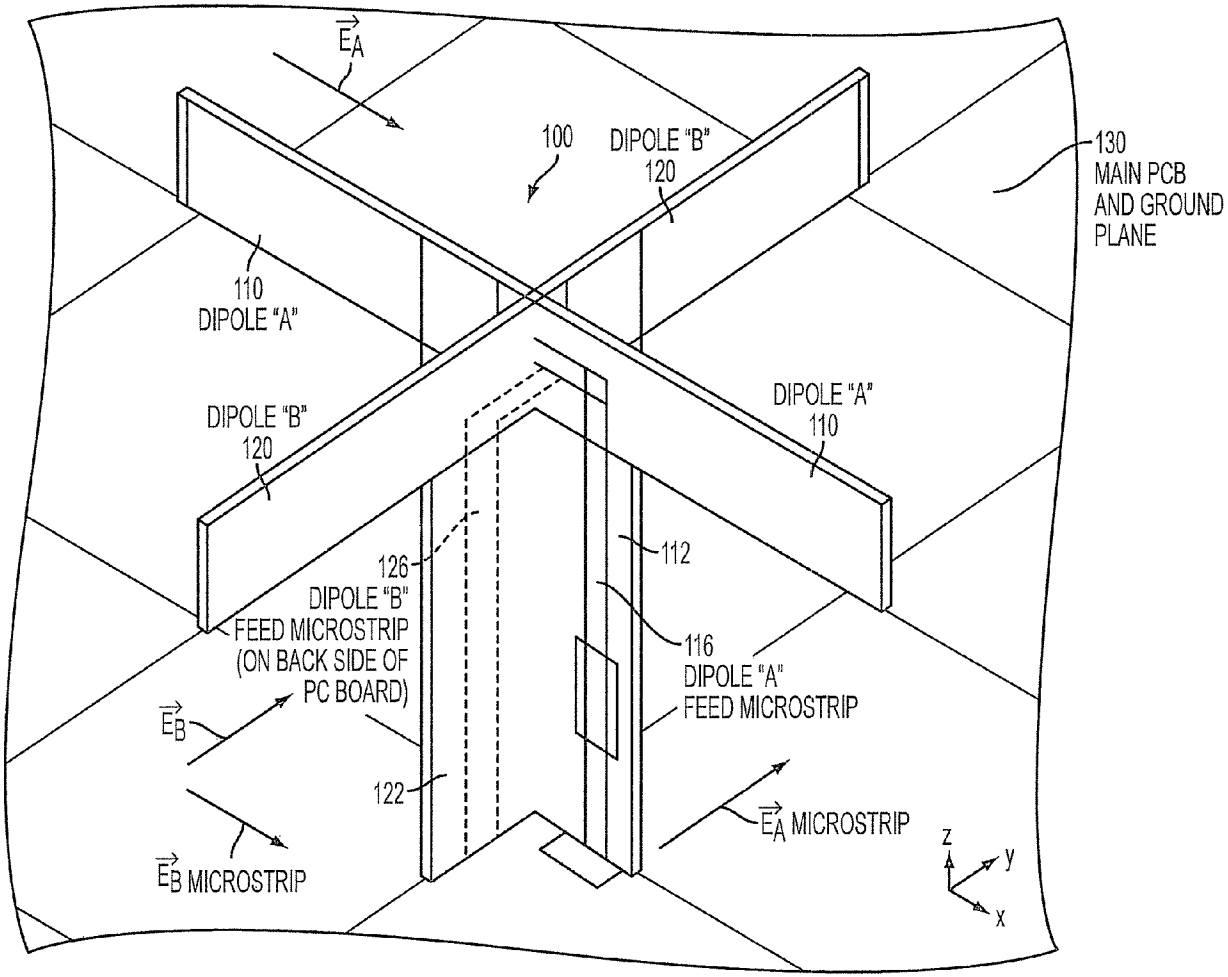
FIG. 1 is a schematic view of an apparatus with orthogonal dipoles and associated feed systems as known in the art.
Figure 2:
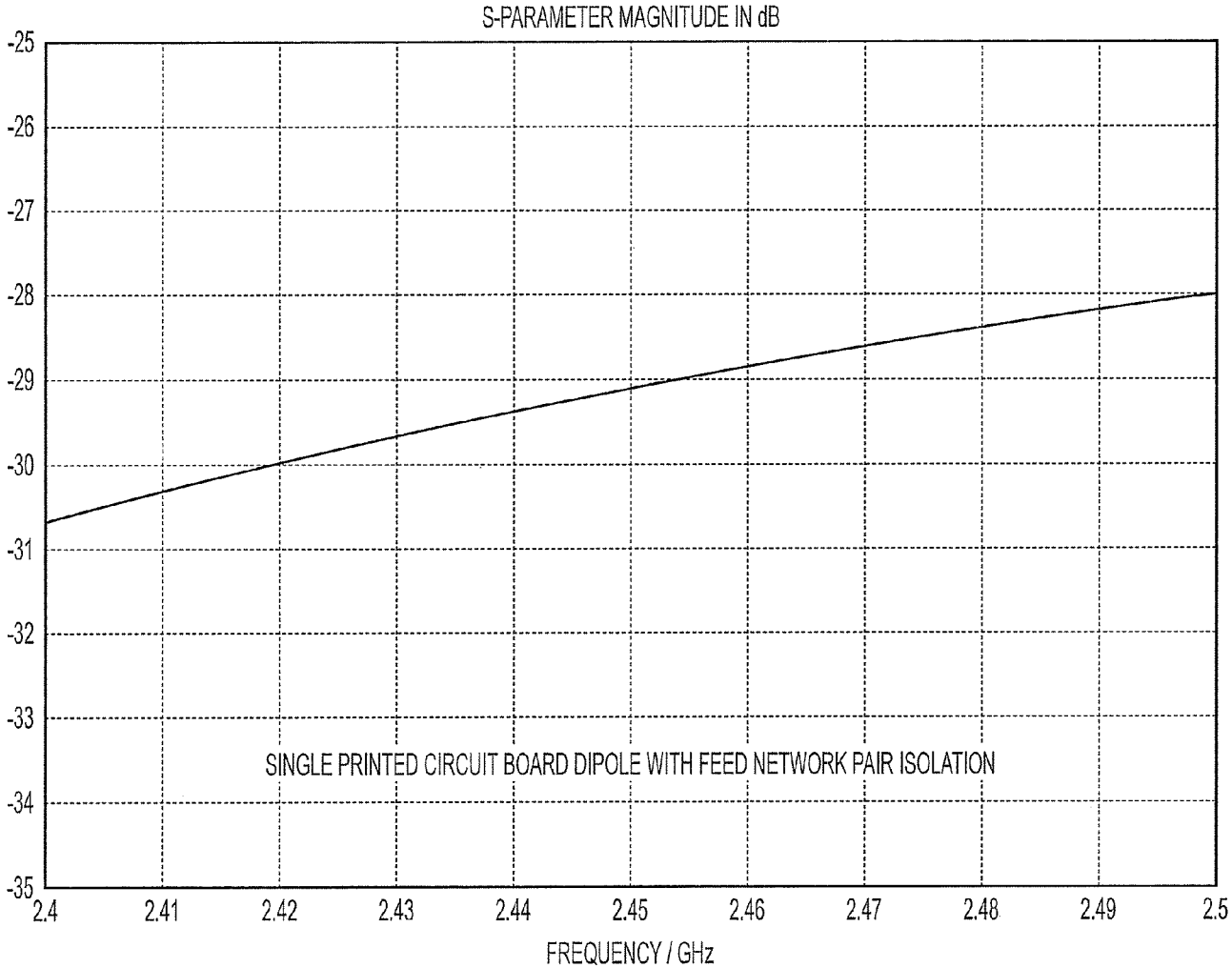
FIG. 2 is graphical representation of the isolation achieved by prior art systems.

While this invention is susceptible of an embodiment in many different forms, there are shown in the drawings and will be described herein in detail specific embodiments thereof with the understanding that the present disclosure is to be considered as an exemplification of the principles of the invention. It is not intended to limit the invention to the specific illustrated embodiments.

Embodiments disclosed herein include a dual polarized antenna and associated feed system with high isolation. For example, an apparatus in accordance with disclosed embodiments can achieve high isolation by orienting the electric field of each dipole parallel to only the electric field of that dipole's feed microstrip. That is, the electric field of each dipole can be orthogonal to an electric field of the other dipole's feed microstrip as well as to the electric field of the other dipole itself.

Figure 3:
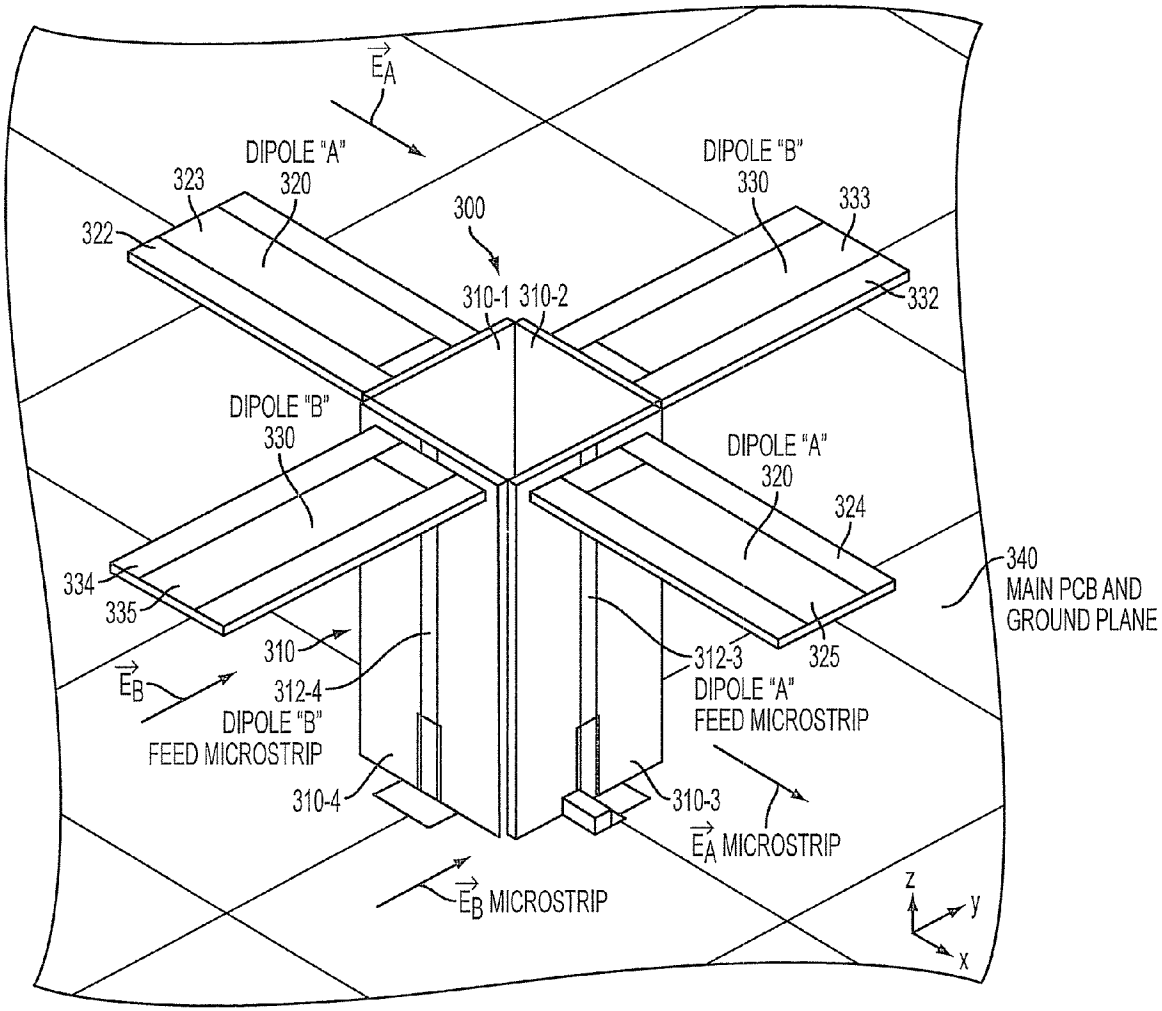
FIG. 3 is a schematic view of an apparatus with dipoles and feed systems in accordance with disclosed embodiments.

FIG. 3 is a schematic view of an apparatus 300 with dipoles and feed systems in accordance with disclosed embodiments. As seen in FIG. 3, the apparatus 300 can include a center support structure 310, a first dipole 320 (Dipole A), and second dipole 330 (Dipole B).

For example, the center support structure 310 can include feed microstrips 312-1, 312-2, 312-3, 312-4 connecting the dipoles 320, 330 to a feed system on or below a main PCB 340 that functions as a ground plane. It is to be understood that the apparatus 300 could include any number of feed microstrips as would be known by those of skill in the art and is not limited to the four feed microstrips shown in FIG. 3.

It is also to be understood that the feed microstrips are not limited to the shape of a strip as shown in FIG. 3. Instead, the feed microstrips could be a transmission line having any shape as would be known by those of skill in the art. For clarity, the transmission lines between feed systems and dipoles will be referred to as feed microstrips herein.

Feed microstrips 312-1, 312-3 can electrically connect the first dipole 320 to the feed system above or below the ground plane 340, and feed microstrips 312-2, 312-4 can electrically connect the second dipole 330 to the feed system above or below the ground plane 340. As seen in FIG. 3, the feed microstrips 312-1, 312-3 can be in a plane that is parallel to the Y-Z plane, and the feed microstrips 312-2, 312-4 can be in a plane that is parallel to the X-Z plane.

In some embodiments, the microstrips 312-1, 312-3, 312-3, 312-4 can be disposed on and/or be supported on or by one or more PCB's, for example, PCB's 310-1, 310-2, 310-3, 310-4. However, it is to be understood that the apparatus 300 could include any number of supporting PCB's as would be known by those of skill in the art and is not limited to the four PCB's shown in FIG. 3. For example, the apparatus 300 could include any number of PCB's that is divisible by four.

When the microstrips 312-1, 312-2, 312-3, 312-4 are disposed on more than one PCB, as shown in FIG. 3, conductive surfaces of the PCB's 310-1, 310-2, 310-3, 310-4 can be connected at the corners thereof. For example, solder can be applied to each corner to facilitate the electrical continuity and conductivity between the PCB's 310-1, 310-3, 310-3, 310-4.

The first dipole 320 can include a first conductor 323 electrically connected to the feed microstrip 312-1 and a second conductor 325 electrically connected to the feed microstrip 312-3. In some embodiments, the conductor 323 can be supported on or by a dielectric support structure 322, and the conductor 325 can be supported on or by a dielectric support structure 324.

Similarly, the second dipole 330 can include a first conductor 333 electrically connected to the feed microstrip 312-2 and a second conductor 335 electrically connected to the feed microstrip 312-4. In some embodiments, the conductor 333 can be supported on or by a dielectric support structure 332, and the conductor 335 can be supported on or by a dielectric support structure 334.

When the feed microstrips 312-1, 312-2, 312-3, 312-4 are disposed on PCB's, each of the PCB's 310-1, 310-2, 310-3, 310-4 can include a key, notch, or other type of cut-out known by those of skill in the art to receive or otherwise mechanically engage a proximate end of the respective conductors 323, 333, 325, 335 and/or respective dielectric support structures 322, 332, 324, 334. In some embodiments, solder can be applied to the mechanical connection of the feed microstrips 312-1, 312-3, 312-3, 312-4 and the respective conductive strips 323, 333, 325, 335 to facilitate the electrical conductivity there between.

The arrangement of the dipoles 320, 330 and feed microstrips 312-1, 312-2, 312-3, 312-4 relative to one another can enable the apparatus 300 to achieve high isolation. For example, the electric field of each dipole can be parallel with only the electric field of its own feed microstrips. Thus, the electric field of each dipole can be orthogonal to an electric field of the other dipole's feed miprostrips as well as to the electric field of the other dipole itself.

Specifically, the electric field $E_A$ of the first dipole 320 can be parallel with only the electric field $E_{A\ MICROSTRIP}$ of the feed microstrips 312-1, 312-3 for the first dipole 320. Similarly, the electric field $E_B$ of the second dipole 330 can be parallel with only the electric field $E_{B\ MICROSTRIP}$ of the feed microstrips 312-2, 312-3 for the second dipole 330. Accordingly, the electric field $E_A$ of the first dipole 320 and the electric field $E_{A\ MICROSTRIP}$ of the feed microstrips 312-1, 312-3, for the first dipole 320 can be orthogonal to the electric field $E_B$ of the second dipole 330 and the electric field $E_{B\ MICROSTRIP}$ of the feed microstrips 312-2, 312-3 for the second dipole 330.

As seen in FIG. 3, the first conductor 323 of the first dipole 320 can extend away from the first microstrip 312-1 of the center support structure 310, and the second conductor 325 of the first dipole 320 can extend away from the third microstrip 312-3 of the center support structure 310. That is, a center line of the conductors 323, 325 of the first dipole 320 can be in a plane that is parallel to the X-Z plane of the apparatus 300 so that the polarization of the first dipole 320 is parallel with the X axis.

In accordance with disclosed embodiments, the conductors 323, 325 of the first dipole 320 can be any shape and can be rotated in any direction as long as a center line of the conductors 323, 325 of the dipole 320 stays a plane that is parallel to the X-Z plane. As explained above and as seen in FIG. 3, the feed microstrips 312-1, 312-3 for the dipole 320 can be in a plane parallel to the Y-Z plane. When a center line of the conductors 323, 325 of the dipole 320 is in a plane parallel to the X-Z plane, but the feed microstrips 312-1, 312-2 for the dipole 320 are in a plane parallel to the Y-Z, the electric field $E_A$ of the first dipole 320 can maintain the parallel relationship with the electric field $E_{A\ MICROSTRIP}$ of the feed microstrips 312-1, 312-3 as described above.

The first conductor 333 of the second dipole 330 can extend away from the second microstrip 312-2 of the center support structure 310, and the second conductor 335 of the second dipole 330 can extend away from the fourth microstrip 312-4 of the center column. That is, the conductors 333, 335 of the second dipole 330 can be in a plane parallel to the Y-Z plane of the apparatus 300 so that the polarization of the second dipole 330 is parallel with the Y axis.

In accordance with disclosed embodiments, the conductors 333, 335 of the second dipole 330 can be any shape and can be rotated in any direction as long as a center line of the conductors 333, 335 of the dipole 330 stays in a plane parallel to the Y-Z plane. As explained above and as seen in FIG. 3, the feed microstrips 312-2, 312-4 for the dipole 330 can be in a plane parallel to the X-Z plane. When a center line of the conductors 333, 335 of the dipole 330 is in a plane parallel to the Y-Z plane, but the feed microstrips 312-2, 312-4 for the dipole 330 are in a plane parallel to the X-Z plane, the electric field $E_B$ of the second dipole 330 can maintain the parallel relationship with the electric field $E_{B\ MICROSTRIP}$ of the feed microstrips 312-3, 312-4 for the second dipole as described above.

As explained above, the apparatus 300 shown in FIG. 3 can achieve high isolation between dipoles and feed systems. For example, coupling between a dipole and an orthogonal dipole's feed microstrip can be greatly reduced and, in some embodiments, substantially eliminated.

Figure 4:
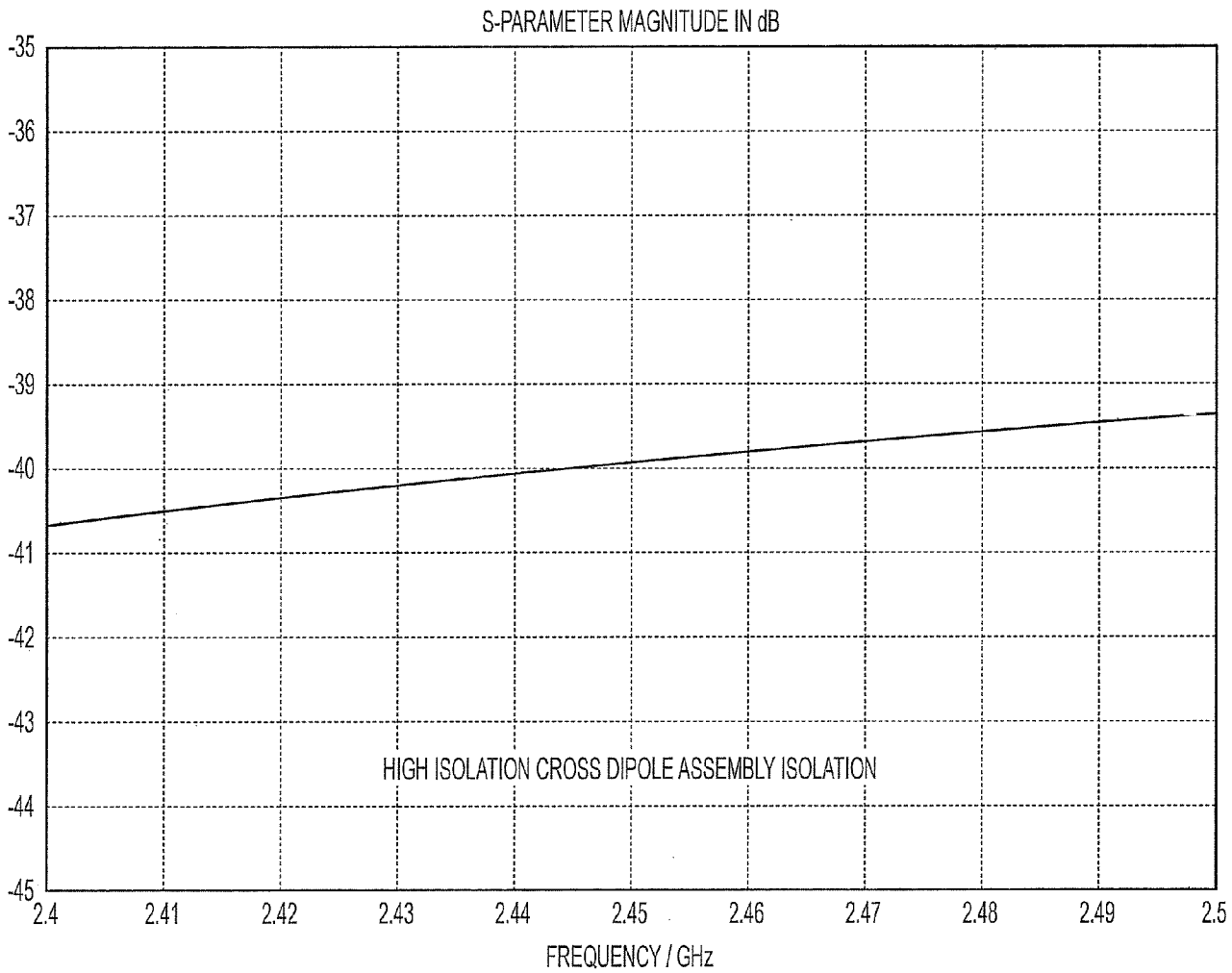
FIG. 4 is a graphical representation of the isolation achieved by the apparatus shown in FIG. 3.

FIG. 4 is a graphical representation of the isolation achieved by the apparatus 300 shown in FIG. 3. As seen in FIG. 4, the isolation between dipoles and feed systems can be substantially improved as compared to known art, for example, the apparatus 100 shown in FIG. 1.

In some embodiments disclosed herein, the apparatus 300 shown in FIG. 3 can include symmetrical and balanced feed systems for each dipole 320, 330. For example, first and second baluns 510, 520 can be employed.

Figure 5:
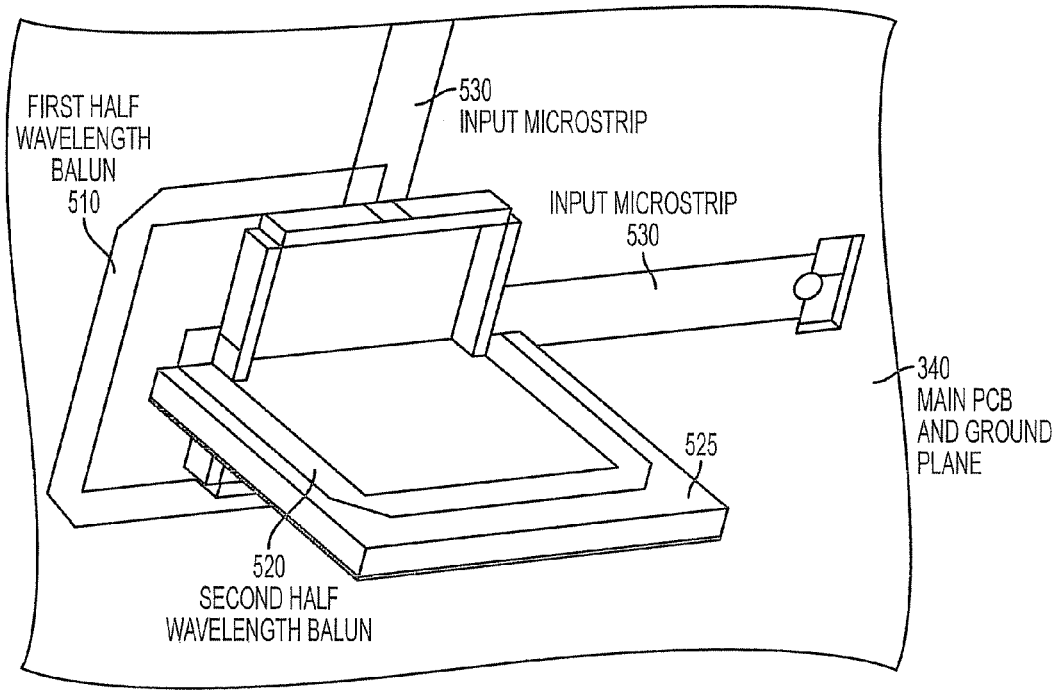
FIG. 5 is a schematic view of first and second baluns in accordance with disclosed embodiments.

FIG. 5 is a schematic view of first and second baluns 510, 520 in accordance with disclosed embodiments. The first balun 510 can be associated with the first dipole 320, and the second balun 520 can be associated with the second dipole 330. Two baluns can be employed because, according to disclosed embodiments, a balun is required for each polarization to make the unbalanced to balanced transformation from input microstrips 530.

In embodiments disclosed herein, geometric limitations prevent the baluns 510, 520 from being disposed in the same plane without crossing one another. Therefore, the first balun 510 can be disposed in a first plane, and the second balun 520 can be disposed in a second plane provided that the first and second planes are different.

For example, as seen in FIG. 5, the first balun 510 can be disposed on a plane parallel to the ground plane 340, and the second balun 520 can be disposed on a plane parallel with an auxiliary PCB 525. In some embodiments, the auxiliary PCB 525 can be orthogonal to the ground plane 340. In other embodiments, the first balun 510 can be disposed on a plane on a first side of the ground plane 340, and the second balun 520 can be formed on a plane on a second side of the ground plane 340. However, embodiments disclosed herein are not limited to the placement or orientation of the planes as long as the plane of the first balun 510 is different than the plane of the second balun 520.

In some embodiments, one or both of the baluns 510, 520 can be of approximately one half wavelength or any odd multiple thereof. However, embodiments disclosed herein are not so limited.

From the foregoing, it will be observed that numerous variations and modifications may be effected without departing from the spirit and scope of the invention. It is to be understood that no limitation with respect to the specific system or method illustrated herein is intended or should be inferred. It is, of course, intended to cover by the appended claims all such modifications as fall within the spirit and scope of the claims.

What is claimed is:

1. An apparatus comprising:

a plurality of transmission lines;

a first dipole electrically connected to a first set of the plurality of transmission lines; and a second dipole electrically connected to a second set of the plurality of transmission lines, wherein the first dipole and the first set of the plurality of transmission lines share a first common plane of symmetry, and wherein an electric field of the first dipole and an electric field of the first set of the plurality of transmission lines are everywhere parallel to the first common plane of symmetry, and wherein the second dipole and the second set of the plurality of transmission lines share a second common plane of symmetry, and wherein an electric field of the second dipole and an electric field of the second set of the plurality of transmission lines are everywhere parallel to the second common plane of symmetry.

2. The apparatus of claim 1 wherein at least one of the plurality of transmission lines includes a feed microstrip.

3. The apparatus of claim 1 wherein at least one of the plurality of transmission lines is disposed on a printed circuit board.

4. The apparatus of claim 1 wherein the first dipole includes a first conductor electrically connected to a first transmission line in the first set of the plurality of transmission lines and a second conductor electrically connected to a second transmission line in the first set of the plurality of transmission lines.

5. The apparatus of claim 4 wherein at least one of the first and second conductors is supported on a dielectric support structure.

6. The apparatus of claim 1 wherein the second dipole includes a first conductor electrically connected to a first transmission line in the second set of the plurality of transmission lines and a second conductor electrically connected to a second transmission line in the second set of the plurality of transmission lines.

7. The apparatus of claim 6 wherein at least one of the first and second conductors is supported on a dielectric support structure.

8. The apparatus of claim 1 wherein the electric field of the first dipole is orthogonal to the electric field of the second set of the plurality of transmission lines.

9. The apparatus of claim 1 wherein the electric field of the first dipole is orthogonal to the electric field of the second dipole.

10. The apparatus of claim 1 wherein the electric field of the second dipole is orthogonal to the electric field of the first set of the plurality of transmission lines.

11. The apparatus of claim 1 wherein the electric field of the first set of the plurality of transmission lines is orthogonal to the electric field of the second set of the plurality of transmission lines.

12. The apparatus of claim 1 further comprising:

a first balun associated with the first dipole; and a second balun associated with the second dipole, wherein the first balun is disposed in a first plane and the second balun is disposed in a second plane.

13. The apparatus of claim 12 wherein the first plane is different than the second plane.

14. The apparatus of claim 12 wherein the first and second planes are parallel to a ground plane, wherein the first plane is on a first side of the ground plane, and wherein the second plane is on a second side of the ground plane.

15. The apparatus of claim 12 wherein the first plane is parallel to a ground plane, and wherein the second plane is at an angle to the ground plane greater than zero.

16. The apparatus of claim 15 wherein the second plane is orthogonal to the ground plane.

17. The apparatus of claim 12 wherein at least one of the first and second baluns is of approximately one half wavelength or an odd multiple thereof.

18. The apparatus of claim 1 wherein the electric field of the first dipole is parallel to the electric field of the first set of the plurality of transmission lines.

19. The apparatus of claim 1 wherein the electric field of the second dipole is parallel to the electric field of the second set of the plurality of transmission lines.

20. The apparatus of claim 1 wherein the electric field of the first dipole and the electric field of the first set of the plurality of transmission lines are everywhere orthogonal to the second common plane of symmetry.

21. The apparatus of claim 1 wherein the electric field of the second dipole and the electric field of the second set of the plurality of transmission lines are everywhere orthogonal to the first common plane of symmetry.

22. A method comprising:

providing a plurality of transmission lines;

providing a first dipole electrically connected to a first set of the plurality of transmission lines;

providing a second dipole electrically connected to a second set of the plurality of transmission lines;

orienting the first dipole relative to the first set of the plurality of transmission lines such that the first dipole and the first set of the plurality of transmission lines share a first common plane of symmetry and such that an electric field of the first dipole and an electric field of the first set of the plurality of transmission lines are everywhere parallel to the first common plane of symmetry; and orienting the second dipole relative to the second set of the plurality of transmission lines such that the second dipole and the second set of the plurality of transmission lines share a second common plane of symmetry and such that an electric field of the second dipole parallel to and an electric field of the second set of the plurality of transmission lines are everywhere parallel to the second common plane of symmetry.

23. The method of claim 22 wherein the electric fields of the first dipole and the first set of the plurality of transmission lines are orthogonal to the electric fields of the second dipole and the second set of the plurality of transmission lines.

24. The method of claim 22 further comprising:

providing a first balun associated with the first dipole; and providing a second balun associated with the second dipole, wherein the first balun is disposed in a first plane and the second balun is disposed in a second plane.

* * * * *